US005127970A

United States Patent [19]

Kim

[11] Patent Number: 5,127,970

[45] Date of Patent: Jul. 7, 1992

[54] METHOD FOR PRODUCING RARE EARTH MAGNET PARTICLES OF IMPROVED COERCIVITY

[75] Inventor: Andrew S. Kim, Pittsburgh, Pa.

[73] Assignee: Crucible Materials Corporation, Syracuse, N.Y.

[21] Appl. No.: 703,759

[22] Filed: May 21, 1991

[51] Int. Cl.[5] ..... H01F 1/02

[52] U.S. Cl. ..... 148/105; 148/101

[58] Field of Search ..... 148/101, 102, 104, 105

[56] References Cited

FOREIGN PATENT DOCUMENTS 63-90104 4/1988 Japan ..... 148/104

1-99201 4/1989 Japan ..... 148/101

*Primary Examiner*—John P. Sheehan

*Attorney, Agent, or Firm*—Finnegan, Henderson, Farabow, Garrett & Dunner

[57] ABSTRACT

A method for improving the magnetic properties, particulaarly intrinsic coercivity, of particles of a permanent magnet alloy comprising a rare earth element, iron and boron. The method includes subjecting particles to a hydrogen atmosphere for a time at elevated temperature sufficient to hydride the particles. The hydrogen atmosphere is removed while maintaining the particles at the elevated temperature. Thereafter, while maintaining the particles at elevated temperature, the particles are subjected to a vacuum atmosphere for a time at the maintained elevated temperature sufficient to dehydride the particles. Thereafter, while maintaining the particles at the elevated temperature, they are again subjected to a hydrogen atmosphere for a time at the maintained elevated temperature sufficient to hydride the particles. The hydrogen atmosphere is removed while maintaining the particles at the elevated temperature. Thereafter, the particles are subjected to a vacuum atmosphere for a time at the maintained elevated temperature sufficient to dehydride the particles. The dehydrided particles are then cooled to room temperature.

14 Claims, 4 Drawing Sheets

METHOD FOR PRODUCING RARE EARTH MAGNET PARTICLES OF IMPROVED COERCIVITY

BACKGROUND OF THE INVENTION

1. Field of the Invention

The invention relates to a method for improving the magnetic properties, particularly intrinsic coercivity, of particles of a permanent magnet alloy of a rare earth element, iron and boron composition.

2. Description of the Prior Art

Permanent magnets of a neodymium, iron, boron composition (Nd-Fe-B), which are well known in the art, are produced by practices including sintering, hot deformation or plastic bonding. The sintered magnets and hot deformed magnets are generally used in applications requiring relatively high magnet properties, particularly energy product, while the bonded magnets are used for applications requiring a moderately high energy product with the shape of the magnet being complex. Bonded magnets comprise particles of a permanent magnet alloy dispersed in a matrix of nonmagnetic material.

In the production of bonded magnets, isotropic Nd-Fe-B permanent magnet alloy powder is produced by the rapid quenching of molten alloy by the well known practice of melt-spinning, and the subsequent heat treatment of the melt-spun alloy ribbons to achieve high coercivity. Melt-spun ribbons of permanent magnet alloy are difficult to process into bonded magnets because particles resulting therefrom are of flat, plate-like shape, e.g. flakes. These flakes are crushed to produce fine powders to facilitate the use thereof in forming bonded magnets. Although these crushed materials have found commercial success in producing bonded magnets, they are nevertheless difficult to process in the conventional injection-molding equipment used to produce plastic bonded magnets because of the relatively poor flowability of the crushed powder.

It is known to produce permanent magnet alloys in powder form by the use of gas atomization. Gas-atomized particles are characterized by a spherical shape. It is also known to produce particles of alloys of this type by casting the alloy and then crushing the solidified casting to produce particles. These particles, are of angular configuration. Both the angular and spherical powders are of a shape that is suitable for use in producing bonded magnets. The spherical shape is preferred for this purpose because the flowability thereof is superior to angular-shaped powder. In this regard, gas-atomized powder typically has a particle size range of 1 to 300 microns.

It has been determined, however, that as-atomized Nd-Fe-B powder has intrinsic coercivity ($H_{ci}$) levels too low for use in the production of bonded magnets. Consequently, attempts have been made to increase the intrinsic coercivity of the as-atomized powder by heat treatment, alloy modification, particle size control, and combinations of these factors. Prior to the present invention, a practice has not been available to uniformly achieve the intrinsic coercivity values in gas-atomized powder rendering the same suitable for use in the manufacture of bonded permanent magnets. This has also been the case with the angular powder resulting from pulverizing of a casting of the permanent magnet alloy. Hence, bonded magnets wherein the alloy particles are dispersed and bonded in a non-magnetic matrix material of a plastic composition, have been commercially produced only from particles resulting from melt-spun ribbon of the Nd-Fe-B permanent magnet alloy.

OBJECTS OF THE INVENTION

It is accordingly a primary object of the present invention to provide a treatment for both gas-atomized and cast permanent magnet alloy particles to improve the magnetic properties thereof, particularly the intrinsic coercivity.

Another object of the invention is to provide for a heat treatment wherein the intrinsic coercivity of gas-atomized and cast alloy particles is increased to a uniform intrinsic coercivity level suitable for use in the production of bonded permanent magnets.

Another object of the invention is to provide gas-atomized particles for use in producing bonded permanent magnets which particles are characterized by improved intrinsic coercivity.

SUMMARY OF THE INVENTION

In accordance with the method of the invention, the magnetic properties, particularly intrinsic coercivity, of particles of a permanent magnet alloy comprising a rare earth element, iron and boron are improved. The method includes subjecting the particles to a hydrogen atmosphere for a time at elevated temperature sufficient to hydride the particles. Thereafter, the particles are subjected to a vacuum atmosphere for a time at the elevated temperature sufficient to dehydride the particles. Then, while maintaining the particles at the elevated temperature, the particles are again subjected to a hydrogen atmosphere for a time at temperature sufficient to hydride the particles. Next, the particles are subjected to a vacuum atmosphere for a time at elevated temperature sufficient to dehydride the particles. Thereafter, the dehydrided particles are cooled to room temperature.

The elevated temperature to which the particles are subjected may be within the range of 660–850° C. and preferably 700–800° C. The hydriding may be conducted for 1.5–2.0 hours. A hydriding pressure greater than 5 psi may be employed.

The particles may be gas-atomized, spherical particles. The invention may also be used with a casting or particles resulting from crushing a casting of a permanent magnet alloy of a rare earth element, iron and boron composition to achieve increased coercivity values.

Gas-atomized, spherical particles are produced in accordance with the practice of the invention, which have a rare earth element, iron and boron composition, characterized by higher intrinsic coercivity than exhibited by the particles in the as-gas atomized condition. The particles also have a finer, more uniform grain structure than exhibited in the as-gas atomized condition.

The term "hydride" as used herein is defined as phase transformation in Nd-Fe-B alloy from $Nd_2Fe_{14}B+\alpha$-$Fe+\alpha$-Nd to $NdH_2+\alpha$-$Fe+Fe_2B$ by introducing hydrogen into the alloy and the term "dehydride" as used herein is defined as hydrogen desorbing phase transformation of Nd-Fe-B alloy from $NdH_2+\alpha$-$Fe+Fe_2B$ phases to a $Nd_2Fe_{14}B$ phase by evacuating hydrogen from the alloy.

DESCRIPTION OF THE PREFERRED EMBODIMENTS

The permanent magnet alloy samples used in the development work and specific examples incident to the invention contained at least one rare earth element, namely Nd or Nd plus a minor amount of other rare earth elements, iron or a combination of iron plus a minor amount of other transition metals, and boron. Hence, all of the alloys used in the investigation were Nd-Fe-B type permanent magnet alloys.

The alloys were produced by vacuum induction melting of a prealloyed charge of the alloy to produce a molten mass of the desired permanent alloy composition. The molten mass was atomized to form fine powder by the use of argon gas or alternately the molten mass was poured into a mold for solidification. The specific alloy compositions are listed in Table 1.

Figure 1:
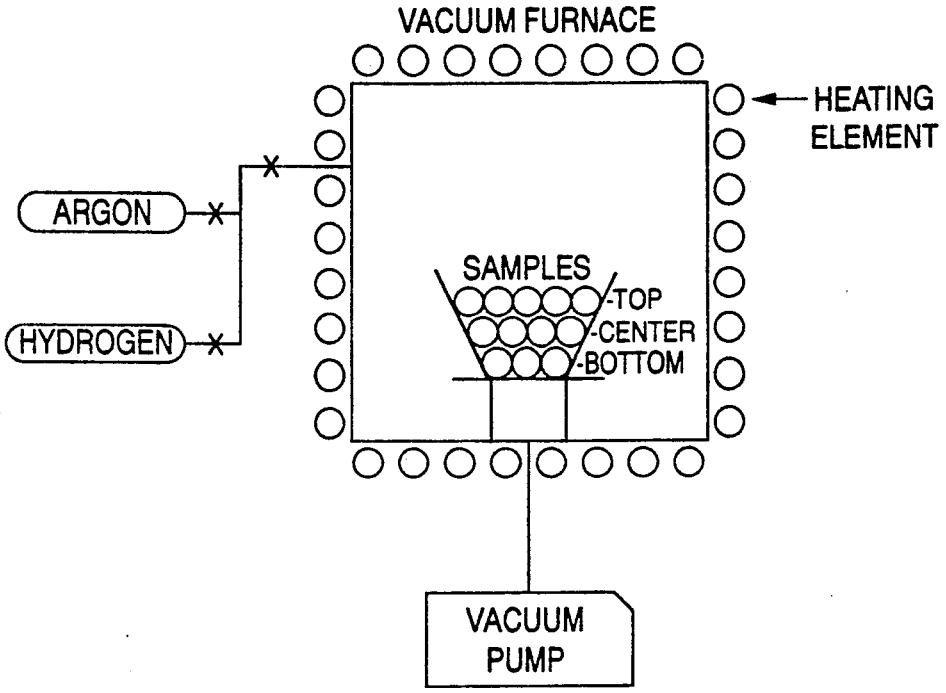
FIG. 1 is a schematic showing of one embodiment of apparatus suitable for use in the practice of the method of the invention.
Figure 2:
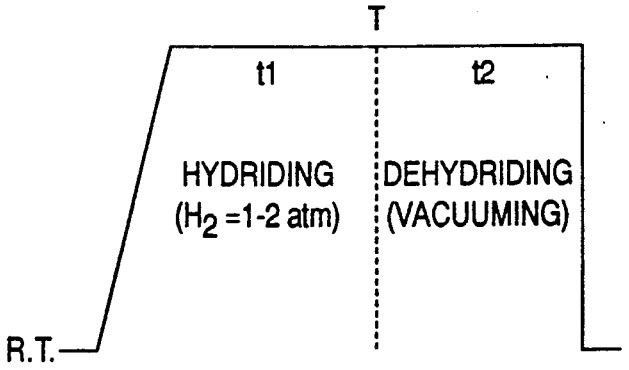
FIG. 2 is a graph showing a hydrogen absorption-desorption treatment (HAD) used in the experimental work performed incident to the development of the invention.

The atomized powders and cast ingots were placed in containers and loaded into a vacuum furnace as shown in FIG. 1. The vacuum furnace was evacuated to 10–100 microns followed by filling of the furnace with argon gas, commonly termed argon flushing. After repeated argon flushing, the furnace was again evacuated to 10–100 microns. Hydrogen gas was then introduced into the furnace at about 1–16 psi and the furnace was heated slowly at a rate of 2°–20° C. per minute to a temperature within the range of 600°–900° C. for isothermal heating to hydride the permanent magnet alloy samples therein. Dehydriding of the samples was effected by evacuating the furnace to 1–100 microns while maintaining the temperature within the range of 600°–900° C. for 0.5–5 hours. Thereafter, the furnace was filled with an inert gas and the dehydrated permanent magnet alloy sample was cooled in this inert gas atmosphere. This heat treatment profile is shown in FIG. 2.

Figure 3:
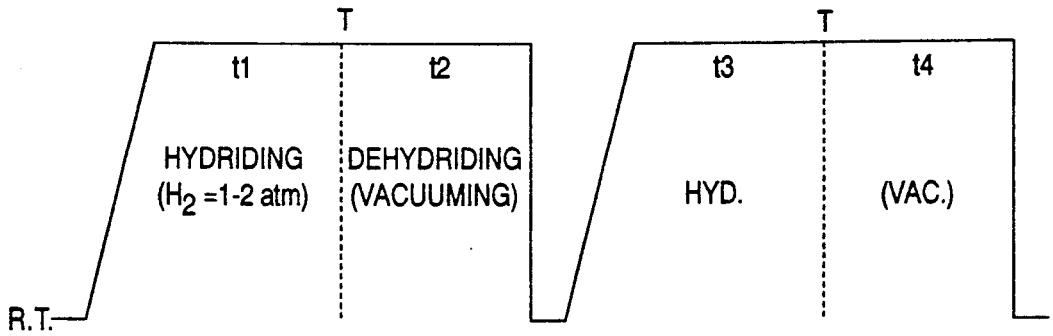
FIG. 3 is a graph showing an additional hydrogen absorption-desorption heat treatment used in the experimental work incident to the development of the invention.

An additional hydriding and dehydriding treatment was provided in accordance with the heat treatment profile shown in FIG. 3. Specifically, the furnace was filled with hydrogen gas at about 1–16 psi and the treatment described above with reference to FIG. 2 was repeated to provide for an additional cycle.

Figure 4:
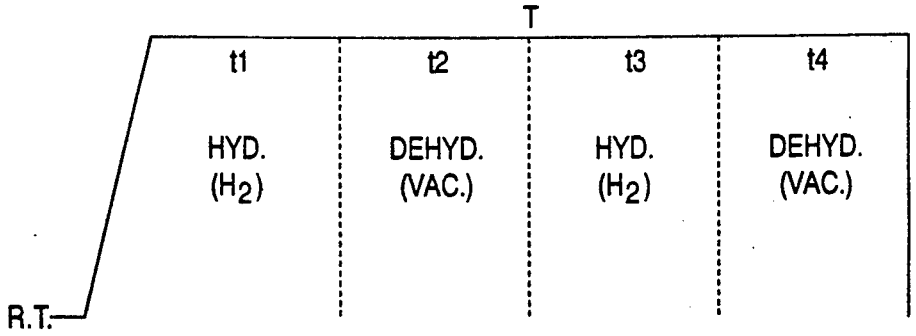
FIG. 4 is a graph showing one embodiment of a heat treatment in accordance with the practice of the invention.

In addition, as shown in FIG. 4, two treatment cycles were employed without the step of cooling in an inert gas atmosphere therebetween. This latter treatment, as shown in FIG. 4, is a practice for hydriding and dehydriding in accordance with an embodiment of the method of the invention.

After cooling, the samples were removed from the furnace and crushed to −40 mesh particle size. The magnetic properties of the powder were measured using a hysteresigraph and a SQUID (superconducting quantum interference device). The phases of the alloy at each stage of the treatment cycle were analyzed with an X-ray diffractometer. The microstructural change of the atomized powder was examined under an optical microscope and a SEM (scanning electron microscope).

TABLE 1

Chemical Compositions of Alloys (by wt. %)

| Alloy No. | Nd | Dy | Fe | B | Al | Co | Pr |
|---|---|---|---|---|---|---|---|
| 1(A) | 33.03 | — | 65.65 | 1.32 | — | — | — |
| 2(A) | 31.5 | — | 67.5 | 1.0 | — | — | — |
| 3(A) | 33.14 | — | 65.45 | 1.41 | — | — | — |
| 4(C) | 26.22 | — | 64.67 | 1.09 | 0.2 | — | 7.62 |
| 5(A) | 32.0 | 2 | 59.35 | 1.3 | 0.35 | 5.0 | — |
| 6(C) | 33.01 | — | 65.76 | 1.13 | 0.1 | — | — |

A: Atomized powder, C: Cast Ingot

TABLE 2

Variation of Hci as a Function of HAD* Treatment Temperature ($H_2$ Pressure = 8 psi)

| | $H_{ci}$ (kOe) | | | | | | |
|---|---|---|---|---|---|---|---|
| Temp (°C.) | 660 | 700 | 720 | 750 | 780 | 800 | 850 |
| Alloy 3 (Avg) | — | 11.0 | — | 13.7 | — | 9.0 | 5.5 |
| Alloy 1 Top | 8.3 | 9.8 | 10.7 | 11.1 | 10.7 | — | — |
| Center | 6.4 | 8.2 | 9.0 | 9.1 | 9.2 | — | 5.3 |

*HAD - Hydrogen absorption desorption

TABLE 3

Variation of Hci as a Function of $H_2$ Pressure (HAD Temperature = 750° C.)

| | $H_{ci}$ (kOe) | | | | |
|---|---|---|---|---|---|
| $H_2$ Pressure (psi) | 1 | 5 | 8 | 10 | 12 |
| Alloy 1 Top | 11.0 | 11.1 | 11.0 | 10.9 | 11.4 |
| Center | 10.3 | 9.5 | 9.4 | 9.1 | 9.0 |
| Alloy 5 Top | 13.4 | 15.0 | 14.9 | 15.0 | 15.0 |
| Center | 12.4 | 12.7 | 12.8 | 13.1 | 12.9 |
| Alloy 4 (Avg.) | 8.9 | 10.1 | 10.0 | 10.1 | 10.0 |

TABLE 4

Variation of Hci as a Function of Hydriding Time at 750° C. ($H_2$ Pressure = 8 psi)

| | $H_{ci}$ (kOe) | | |
|---|---|---|---|
| Time (Hrs) | 1.5 | 1.8 | 2.0 |
| Alloy 1 Top | 11.3 | 11.2 | 11.6 |
| Center | 9.1 | 9.2 | 9.1 |
| Alloy 5 Top | 14.7 | 14.2 | 14.7 |
| Center | 12.7 | 12.4 | 12.5 |

TABLE 5

Variation of Hci as a Function of Dehydriding Time and Vacuum Degree at 750° C. ($H_2$ Pressure = 8 psi)

| | $H_{ci}$ (kOe) | | | |
|---|---|---|---|---|
| Time(Hr) | 1.5 | 2.0 | 2.5 | 3.0 |
| Vacuum (microns) | 53 | 23 | 22 | 24 |
| Alloy 1 Top | 7.3 | 11.6 | 11.5 | — |
| Center | 10.5 | 11.6 | 11.0 | — |
| Bottom | 8.1 | 10.6 | 8.8 | — |
| Alloy 5 Top | 14.6 | 15.3 | 15.3 | 15.3 |
| Center | 13.7 | 14.3 | 13.7 | 13.4 |
| Bottom | 11.0 | 11.6 | 11.8 | 11.7 |

TABLE 6

Variation of Hci of Alloy 1 as a Function of Hydriding and Dehydriding Temperatures. ($H_2$ Pressure = 8 psi)

| Temp. (°C.) | | $H_{ci}$ (kOe) | |
|---|---|---|---|
| Hyd. | Dehyd. | Top | Center |
| 720 | 720 | 10.7 | 9.0 |
| 720 | 750 | 11.1 | 9.1 |
| 720 | 780 | 10.7 | 9.2 |
| 750 | 720 | 10.0 | 9.9 |
| 750 | 750 | 11.6 | 9.1 |
| 750 | 780 | 11.3 | 9.1 |
| 780 | 720 | 11.9 | 10.1 |
| 780 | 750 | 12.1 | 10.8 |
| 780 | 780 | 11.8 | 10.0 |

TABLE 7

Coercivities of Various Atomized Alloys After Double HAD Treatments. ($H_2$ Pressure = 8 psi)

| | $H_{ci}$ (kOe) | | |
|---|---|---|---|
| | Top | Center | Bottom |
| Alloy 1 | 12.5 | 12.3 | 10.4 |
| Alloy 2 | 11.8 | 12.6 | 12.1 |
| Alloy 5 | 15.5 | 15.1 | 10.8 |

TABLE 8

Coercivities of Various Atomized Powder After Cyclic HAD Treatment.

| | | $H_{ci}$ (kOe) | | |
|---|---|---|---|---|
| | Cycle | Top | Center | Bottom |
| Alloy 1 | (1) | 13.1 | 14.0 | 12.2 |
| | (2) | 12.0 | 12.8 | 12.2 |
| | (3) | 12.6 | 13.4 | 12.6 |
| Alloy 2 | (1) | 11.8 | 12.6 | 12.1 |
| | (1) | 11.6 | 11.6 | 11.6 |
| | (1) | 11.8 | 11.7 | 11.7 |
| Alloy 5 | (1) | 19.9 | 18.6 | 19.0 |
| | (2) | 19.0 | 18.4 | 18.1 |
| | (3) | 17.4 | 17.7 | 18.2 |

(1) 750° C./1.5 Hr/8 psi-750° C./2 Hr/Vac-750° C./1.5 Hr/8 psi-750° C./2.0 Hr/Vac(34μ)
(2) 780° C./1.5 Hr/8 psi-740° C./2 Hr/Vac-780° C./1.5 Hr/8 psi-740° C./1.5 Hr/Vac(28μ)
(3) 740° C./1.5 Hr/8 psi-780° C./2 Hr/Vac-740° C./1.5 Hr/8 psi-780° C./1.5 Hr/Vac(39μ)

TABLE 9

Magnetic Properties of Various Alloys Measured with SQUID After HAD Treatments.

| Alloy | $B_r$ (KG) | $H_{ci}$ (kOe) | $(BH)_{max}$ (MGO) |
|---|---|---|---|
| 1 (single) | 7.2 | 14.3 | 11.2 |
| 2 (single) | 7.6 | 10.6 | 12.2 |
| 3 (single) | 7.2 | 13.9 | 11.2 |
| 4 (single) | 7.2 | 10.1 | 11.2 |
| 5 (single) | 6.4 | 15.4 | 8.9 |
| 6 (cyclic) | 7.75 | 11.7 | 12.7 |

The treatment of the alloys, which may be termed as a hydrogen absorption-desorption treatment, was conducted at different temperatures while maintaining the hydrogen pressure at 8 psi during the hydriding portion of the treatment. The variation of the magnetic properties, namely intrinsic coercivity ($H_{ci}$), as a function of this treatment is illustrated in Table 2. As shown in Table 2, the intrinsic coercivity increases rapidly as the treatment temperature is increased from 660°-700° C. and then increases at a slower rate with temperature increases to a maximum temperature of about 750° C. Further temperature increases results in a decrease of the intrinsic coercivity. When the treatment temperature exceeds 800° C., the intrinsic coercivity decreases rapidly. Therefore, the optimum treatment temperature is about 750° C. with the maximum temperature being about 800° C. It may be noted that the coercivity varies somewhat depending upon the location of the sample in the container. FIG. 1 presents a schematic showing of the sample loaded in the container and the location of the samples examined. The top layers usually exhibit the highest coercivity.

A hydrogen absorption-desorption treatment was conducted by varying the hydrogen pressure during the hydriding period while maintaining the temperature at 750° C. As shown in Table 3, the intrinsic coercivity achieved was independent of the hydrogen pressure as long as the hydrogen pressure exceeds 5 psi. Intrinsic coercivity was somewhat degraded when the hydrogen pressure was about 1 psi (about 1 atmosphere). The non-uniformity of the intrinsic coercivity across the sample location resulted in all cases and this result was not improved by increasing the hydrogen pressure.

Magnetic properties were determined with respect to treatments wherein the hydriding time was varied while maintaining the temperature at 750° C. and the hydrogen pressure at 8 psi. As shown in Table 4, the intrinsic coercivity was independent of the hydriding time with respect to samples hydrided for 1.5-2.0 hours at 750° C. and 8 psi of hydrogen. Hence, the non-uniformity with regard to the intrinsic coercivity was not improved by changing the hydriding time. Similar results were obtained with respect to treatments wherein the dehydriding time and degree of vacuum were changed after hydriding at 750° C. for 1.5 hours at 8 psi hydrogen pressure. As shown in Table 5, the coercivity increased as dehydriding time increased from 1.5-2.0 hours and thereafter changed very little with further increases in dehydriding time from 2-3 hours. Improved uniformity of the coercivity across the sample location was not obtained by increasing the dehydriding time.

The magnetic properties were also examined with respect to treatments wherein changes in the hydriding temperature and the dehydriding temperature were made, while maintaining hydriding time at 1.5 hours at 8 psi hydrogen pressure. As shown in Table 6, the intrinsic coercivity increased slightly during hydriding at 780° C. for 1.5 hours and dehydriding at 750° C. for 2 hours. The overall intrinsic coercivity, however, was not changed significantly by this treatment as compared to the above-described isothermal treatment. Hence, the non-uniformity with regard to intrinsic coercivity across the sample location was present despite changing the hydriding and dehydriding temperatures in accordance with this treatment.

As shown in FIG. 3, the hydrogen absorption-desorption cycle was repeated at 750° C. and 8 psi hydrogen pressure on the samples previously subjected to this treatment. As shown in Table 7, the uniformity with respect to the intrinsic coercivity was improved somewhat for some of the samples. It may be noted, however, that there is nevertheless a significant difference between the top layer and the bottom layer regarding the intrinsic coercivity for some of the samples tested.

As shown in FIG. 4, the hydriding-dehydriding cycle was repeated at identical temperature conditions without the intermediate cooling and heating steps of the treatment shown in FIG. 3 and described above. The coercivity values of the various alloy samples at different locations after the treatment shown in FIG. 4 are listed in Table 8. As shown in Table 8, the intrinsic coercivity of each alloy sample is uniform across the sample location. In addition, the coercivity values have substantially increased with respect to this dual treatment over that of the single hydrogen absorption-desorption treatment. With respect to the various dual treatments, the isothermal treatment at 750° C. resulted in the highest coercivity values. It may be seen from this data, therefore, that the dual treatment improves not only the uniformity but also the magnitude of the magnetic properties, specifically intrinsic coercivity.

Table 9 lists the magnetic properties of samples of various alloys measured with a hysteresigraph and SQUID after single hydrogen absorption-desorption treatments and dual treatments, the latter being in accordance with the method of the invention. It may be seen from the data presented in Table 9 that the magnetic properties of the sample of gas-atomized particles are comparable to the magnetic properties of the samples made from cast ingot particles. The magnetic properties of the $Nd_2Fe_{14}B$ type atomized powder are also similar to those of melt-spun $Nd_2Fe_{14}B$ ribbons which are reported as having the following properties: $B\gamma=7.4-8.0$ KG, $H_{ci}=9.0-14.8$ kOe, and $(BH)_{max}=11.0-12.5$ MGO. In addition, however, the gas-atomized particles before and after HAD treatment are of spherical configuration and thus provide for more efficient use with respect to the production of bonded magnets from the standpoint of improved flowability. Flowability is an important characteristic in the production of bonded magnets produced by the use of conventional injection molding equipment. With spherical particles, as opposed to the plate-shaped particles resulting from melt-spinning and angular-shaped particles resulting from comminution, improved particle flow and dispersion within the plastic matrix material during injection molding incident to magnet production are achieved.

To identify the characteristics of gas-atomized, spherical particles produced in accordance with the invention in contrast to conventional as-gas atomized particles and conventional as-cast particles, sample particles in accordance with the invention and conventional as-gas atomized and as-cast particles were examined to determine intrinsic coercivity and microstructure. The following Table 10 contains coercivity values for particles produced in accordance with the invention and conventional particles.

TABLE 10

| | Invention Particles | As Atomized (or cast) Particles | Heat Treated Melt Spun Ribbons |
|---|---|---|---|
| Alloy 1 (A) | 14.3 kOe | 1.1 kOe | — |
| Alloy 6 (C) | 11.7 kOe | 0.3 kOe | — |

TABLE 10-continued

| | Invention Particles | As Atomized (or cast) Particles | Heat Treated Melt Spun Ribbons |
|---|---|---|---|
| Melt Spun | — | — | 9.0–14.8 kOe |

As shown in this Table, the coercivities of the invention Nd-Fe-B powder are much higher than those of the as-atomized (or as-cast) powder and comparable to those of the melt spun ribbons. The atomized powder has the advantage of excellent flowability compared to melt spun ribbons for injection molding applications.

X-ray diffraction analysis for the invention Nd-Fe-B particles exhibits mainly $Nd_2Fe_{14}B$ phase without $\alpha$-Fe phase which is apparent in as-atomized or as-cast particles. The microstructures of the cross section of the invention Nd-Fe-B particles exhibit a uniform and very fine grain structure while those of the as-atomized (or as-cast) Nd-Fe-B particles exhibit thick Nd-rich boundaries and dendrites.

Figure 5A:
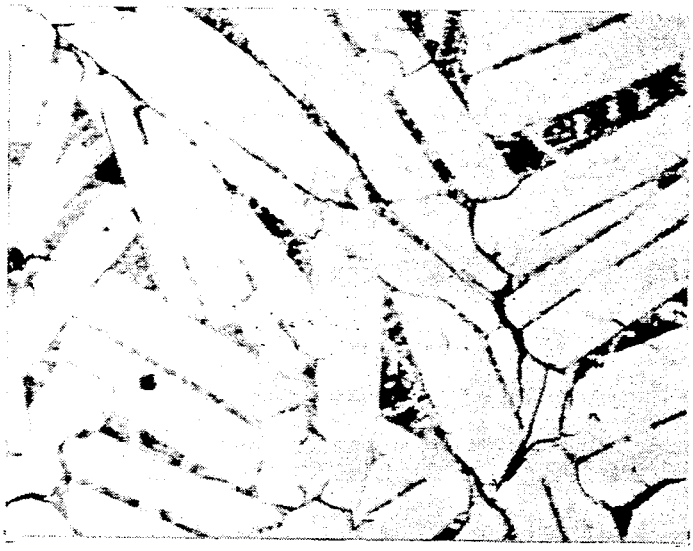
FIG. 5A is a photomicrograph at a magnification of 1000 X showing the microstructure of an as-atomized Nd-Fe-B permanent magnetic alloy particle.
Figure 5B:
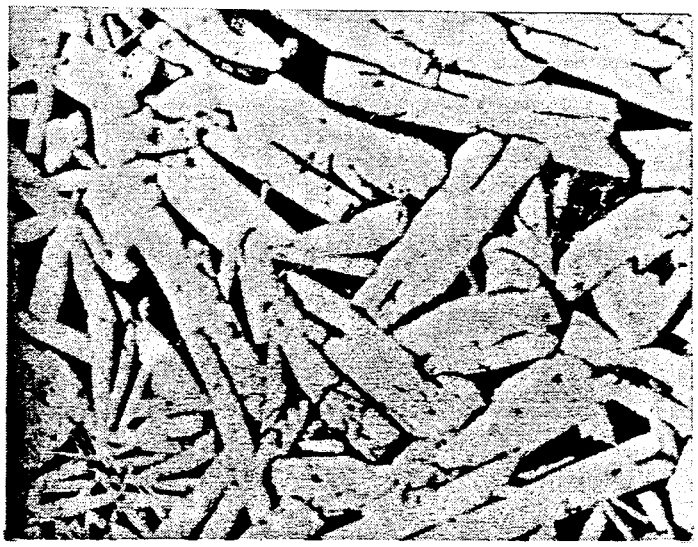
FIG. 5B is a similar photomicrograph of a particle of the same composition etched with Villera's etchant for 25 seconds.
Figure 6A:
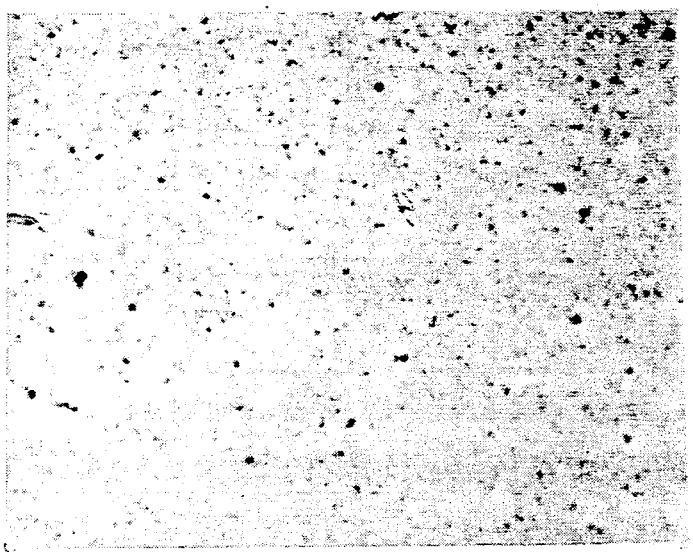
FIG. 6A is a photomicrograph similar to FIG. 5A of a permanent magnet alloy particle in accordance with the invention.
Figure 6B:
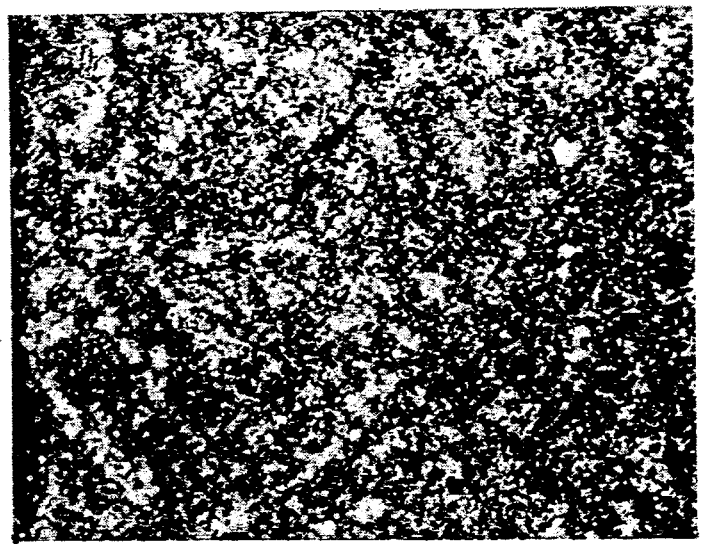
FIG. 6B is a photomicrograph similar to FIG. 5B of a permanent magnet alloy particle in accordance with the invention etched with Villera's etchant for 5 seconds.

FIGS. 5 and 6 are photomicrographs of cross-sections of gas atomized Nd-Fe-B powders of a powder particle size within the range of 200–300 microns of an as-gas atomized particle and a gas atomized particle treated in accordance with the method of the invention. As shown by these photomicrographs, the particle of the invention exhibits a uniformly very fine grain structure relative to the conventional particle.

What is claimed is:

1. A method for improving the magnetic properties, particularly intrinsic coercivity, of particles of a permanent magnet alloy comprising a rare earth element, iron and boron, said method comprising subjecting said particles to a hydrogen atmosphere for a time at elevated temperature within a range of 660°–850° C. sufficient to hydride said particles, removing said hydrogen atmosphere while maintaining said particles at said elevated temperature, thereafter subjecting said particles to a vacuum atmosphere for a time at said maintained elevated temperature sufficient to dehydride said particles and thereafter while maintaining said particles at said elevated temperature again subjecting said particles to a hydrogen atmosphere for a time at said maintained elevated temperature sufficient to hydride said particles, removing said hydrogen atmosphere while maintaining said particles at said elevated temperature, thereafter subjecting said particles to a vacuum atmosphere for a time at said maintained elevated temperature sufficient to dehydride said particles and thereafter cooling said dehydrided particles to room temperature.

2. The method of claim 1, wherein said elevated temperature is within the range of 700°–800° C.

3. The method of claim 1, wherein said hydriding is conducted for 1.5–2.0 hours.

4. The method of claim 1, wherein said hydriding is conducted at a pressure greater than 5 psi.

5. The method of claim 1, wherein said particles are gas-atomized, spherical particles.

6. The method of claim 5, wherein said elevated temperature is within the range of 700°–800° C.

7. The method of claim 5, wherein said hydriding is conducted for 1.5–2.0 hours.

8. The method of claim 5, wherein said hydriding is conducted at a pressure greater than 5 psi.

9. A method for improving the magnetic properties, particularly intrinsic coercivity, of particles of a permanent magnet alloy comprising a rare earth element, iron and boron, said method comprising subjecting said particles to a hydrogen atmosphere for a time at elevated temperature sufficient to hydride said particles, said time being within a time range of 1.5–2.0 hours and said temperature being within a temperature range of 660°–850° C., removing said hydrogen atmosphere while maintaining said particles at an elevated temperature within said temperature range, thereafter subjecting said particles to a vacuum atmosphere for a time at a maintained elevated temperature within said temperature range sufficient to dehydride said particles and thereafter while maintaining said particles at an elevated temperature within said temperature range again subjecting said particles to a hydrogen atmosphere for a time within said time range at a maintained temperature within said temperature range sufficient to hydride said particles, removing said hydrogen atmosphere while maintaining said particles at said elevated temperature, thereafter subjecting said particles to a vacuum atmosphere for a time at a maintained elevated temperature within said temperature range sufficient to dehydride said particles and thereafter cooling said dehydrided particles to room temperature.

10. The method of claim 9, wherein said particles are gas-atomized, spherical particles.

11. The method of claim 9, wherein said hydriding is conducted at a pressure greater than 5 psi.

12. The method of claim 10, wherein said hydriding is conducted at a pressure greater than 5 psi.

13. The method of claim 9, wherein said elevated temperature is within the range of 700°–800° C.

14. The method of claim 10, wherein said elevated temperature is within the range of 700°–800° C.

* * * * *